US007694744B2

(12) United States Patent
Shahin

(10) Patent No.: US 7,694,744 B2
(45) Date of Patent: Apr. 13, 2010

(54) ONE-POSITION FILL-UP AND CIRCULATING TOOL AND METHOD

(75) Inventor: David Shahin, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 66 days.

(21) Appl. No.: 11/331,397

(22) Filed: Jan. 12, 2006

(65) Prior Publication Data

US 2006/0151181 A1 Jul. 13, 2006

Related U.S. Application Data

(60) Provisional application No. 60/643,339, filed on Jan. 12, 2005.

(51) Int. Cl.
*E21B 19/00* (2006.01)

(52) U.S. Cl. ..... 166/380; 166/77.1; 166/90.1

(58) Field of Classification Search ..... 166/380, 166/379, 90.1, 77.1
See application file for complete search history.

(56) References Cited

U.S. PATENT DOCUMENTS

| | | | |
|---|---|---|---|
| 179,973 | A | 7/1876 | Thornton |
| 1,367,156 | A | 2/1921 | McAlvay et al. |
| 1,414,207 | A | 4/1922 | Reed |
| 1,418,766 | A | 6/1922 | Wilson |
| 1,585,069 | A | 5/1926 | Youle |
| 1,728,138 | A | 9/1929 | Power |
| 1,777,592 | A | 10/1930 | Thomas |
| 1,805,007 | A | 5/1931 | Pedley |
| 1,822,444 | A | 9/1931 | MacClatchie |
| 1,825,026 | A | 9/1931 | Thomas |
| 1,842,638 | A | 1/1932 | Wigle |
| 1,917,135 | A | 7/1933 | Littell |
| 2,105,885 | A | 1/1938 | Hinderliter |
| 2,128,430 | A | 8/1938 | Pryor |
| 2,167,338 | A | 7/1939 | Murcell |

(Continued)

FOREIGN PATENT DOCUMENTS

| | | |
|---|---|---|
| CA | 2 307 386 | 11/2000 |

(Continued)

OTHER PUBLICATIONS

UK Search Report, Application No. GB0600615.9, dated May 15, 2006.

(Continued)

*Primary Examiner*—David J Bagnell
*Assistant Examiner*—Robert E Fuller
(74) *Attorney, Agent, or Firm*—Patterson & Sheridan, L.L.P.

(57) ABSTRACT

Embodiments of the present invention include methods and apparatus for circulating fluid through casing and filling the casing with fluid using a combination fill-up and circulating tool while maintaining the fill-up/circulating tool in substantially the same position relative to the casing. In one embodiment, the fill-up/circulating tool includes a mandrel insertable into casing and having a sealing element therearound, the sealing element capable of sealingly engaging with an outer diameter of the mandrel to permit circulating fluid through the casing. The fill-up/circulating tool is also capable of allowing air flow around the outer diameter of the mandrel for the operation of filling the casing with fluid without the need to move the mandrel within the casing.

47 Claims, 5 Drawing Sheets

U.S. PATENT DOCUMENTS

| | | | | |
|---|---|---|---|---|
| 2,184,681 | A | | 12/1939 | Osmun et al. |
| 2,214,429 | A | | 9/1940 | Miller |
| 2,414,719 | A | | 1/1947 | Cloud |
| 2,522,444 | A | | 9/1950 | Grable |
| 2,536,458 | A | | 1/1951 | Munsinger |
| 2,570,080 | A | | 10/1951 | Stone |
| 2,582,987 | A | | 1/1952 | Hagenbook |
| 2,595,902 | A | | 5/1952 | Stone |
| 2,610,690 | A | | 9/1952 | Beatty |
| 2,641,444 | A | | 6/1953 | Moon |
| 2,668,689 | A | | 2/1954 | Cormany |
| 2,692,059 | A | | 10/1954 | Bolling, Jr. |
| 2,953,406 | A | | 9/1960 | Young |
| 2,965,177 | A | | 12/1960 | Bus, Sr. et al. |
| 3,041,901 | A | | 7/1962 | Knights |
| 3,087,548 | A | | 4/1963 | Wooley |
| 3,122,811 | A | | 3/1964 | Gilreath |
| RE25,639 | E | * | 9/1964 | Clark, Jr. et al. ..... 166/129 |
| 3,147,992 | A | | 9/1964 | Haeber et al. |
| 3,191,683 | A | | 6/1965 | Alexander |
| 3,193,118 | A | | 7/1965 | Kenneday et al. |
| 3,266,582 | A | | 8/1966 | Homanick |
| 3,305,021 | A | | 2/1967 | Lebourg |
| 3,321,018 | A | | 5/1967 | McGill |
| 3,380,528 | A | | 4/1968 | Timmons |
| 3,392,609 | A | | 7/1968 | Bartos |
| 3,460,624 | A | * | 8/1969 | Droulers et al. ..... 166/285 |
| 3,477,527 | A | | 11/1969 | Koot |
| 3,489,220 | A | | 1/1970 | Kinley |
| 3,518,903 | A | | 7/1970 | Ham et al. |
| 3,548,938 | A | | 12/1970 | Kilgore et al. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,566,505 | A | | 3/1971 | Martin |
| 3,570,598 | A | | 3/1971 | Johnson |
| 3,602,302 | A | | 8/1971 | Kluth |
| 3,606,664 | A | | 9/1971 | Weiner |
| 3,635,105 | A | | 1/1972 | Dickmann et al. |
| 3,638,989 | A | | 2/1972 | Sandquist |
| 3,662,842 | A | | 5/1972 | Bromell |
| 3,680,412 | A | | 8/1972 | Mayer et al. |
| 3,691,825 | A | | 9/1972 | Dyer |
| 3,697,113 | A | | 10/1972 | Palauro et al. |
| 3,698,426 | A | | 10/1972 | Litchfield et al. |
| 3,700,048 | A | | 10/1972 | Desmoulins |
| 3,706,347 | A | | 12/1972 | Brown |
| 3,746,330 | A | | 7/1973 | Taciuk |
| 3,747,675 | A | | 7/1973 | Brown |
| 3,766,991 | A | | 10/1973 | Brown |
| 3,776,320 | A | | 12/1973 | Brown |
| 3,780,883 | A | | 12/1973 | Brown |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,871,618 | A | | 3/1975 | Funk |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,913,687 | A | | 10/1975 | Gyongyosi et al. |
| 3,915,244 | A | | 10/1975 | Brown |
| 3,961,399 | A | | 6/1976 | Boyadjieff |
| 3,964,552 | A | | 6/1976 | Slator |
| 3,980,143 | A | | 9/1976 | Swartz et al. |
| 4,054,332 | A | | 10/1977 | Bryan, Jr. |
| 4,077,525 | A | | 3/1978 | Callegari et al. |
| 4,100,968 | A | | 7/1978 | Delano |
| 4,127,927 | A | | 12/1978 | Hauk et al. |
| 4,142,739 | A | | 3/1979 | Billingsley |
| 4,202,225 | A | | 5/1980 | Sheldon et al. |
| 4,221,269 | A | | 9/1980 | Hudson |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,280,380 | A | | 7/1981 | Eshghy |
| 4,315,553 | A | | 2/1982 | Stallings |
| 4,320,915 | A | | 3/1982 | Abbott et al. |
| 4,377,179 | A | | 3/1983 | Giebeler |
| 4,401,000 | A | | 8/1983 | Kinzbach |
| 4,437,363 | A | | 3/1984 | Haynes |
| 4,440,220 | A | | 4/1984 | McArthur |
| 4,446,745 | A | | 5/1984 | Stone et al. |
| 4,449,596 | A | | 5/1984 | Boyadjieff |
| 4,472,002 | A | | 9/1984 | Beney et al. |
| 4,489,794 | A | | 12/1984 | Boyadjieff |
| 4,492,134 | A | | 1/1985 | Reinhldt et al. |
| 4,494,424 | A | | 1/1985 | Bates |
| 4,515,045 | A | | 5/1985 | Gnatchenko et al. |
| 4,529,045 | A | | 7/1985 | Boyadjieff et al. |
| 4,570,706 | A | | 2/1986 | Pugnet |
| 4,592,125 | A | | 6/1986 | Skene |
| 4,593,584 | A | | 6/1986 | Neves |
| 4,593,773 | A | | 6/1986 | Skeie |
| 4,604,724 | A | | 8/1986 | Shaginian et al. |
| 4,604,818 | A | | 8/1986 | Inoue |
| 4,605,077 | A | | 8/1986 | Boyadjieff |
| 4,613,161 | A | | 9/1986 | Brisco |
| 4,625,796 | A | | 12/1986 | Boyadjieff |
| 4,646,827 | A | | 3/1987 | Cobb |
| 4,649,777 | A | | 3/1987 | Buck |
| 4,652,195 | A | | 3/1987 | McArthur |
| 4,667,752 | A | | 5/1987 | Berry et al. |
| 4,676,312 | A | | 6/1987 | Mosing et al. |
| 4,681,158 | A | | 7/1987 | Pennison |
| 4,681,162 | A | | 7/1987 | Boyd |
| 4,683,962 | A | | 8/1987 | True |
| 4,686,873 | A | | 8/1987 | Lang et al. |
| 4,709,599 | A | | 12/1987 | Buck |
| 4,709,766 | A | | 12/1987 | Boyadjieff |
| 4,725,179 | A | | 2/1988 | Woolslayer et al. |
| 4,735,270 | A | | 4/1988 | Fenyvesi |
| 4,738,145 | A | | 4/1988 | Vincent et al. |
| 4,742,876 | A | | 5/1988 | Barthelemy et al. |
| 4,759,239 | A | | 7/1988 | Hamilton et al. |
| 4,762,187 | A | | 8/1988 | Haney |
| 4,765,401 | A | | 8/1988 | Boyadjieff |
| 4,765,416 | A | | 8/1988 | Bjerking et al. |
| 4,773,689 | A | | 9/1988 | Wolters |
| 4,781,359 | A | | 11/1988 | Matus |
| 4,791,997 | A | | 12/1988 | Krasnov |
| 4,793,422 | A | | 12/1988 | Krasnov |
| 4,800,968 | A | | 1/1989 | Shaw et al. |
| 4,813,493 | A | | 3/1989 | Shaw et al. |
| 4,813,495 | A | | 3/1989 | Leach |
| 4,821,814 | A | | 4/1989 | Willis et al. |
| 4,832,552 | A | | 5/1989 | Skelly |
| 4,836,064 | A | | 6/1989 | Slator |
| 4,843,945 | A | | 7/1989 | Dinsdale |
| 4,867,236 | A | | 9/1989 | Haney et al. |
| 4,875,530 | A | | 10/1989 | Frink et al. |
| 4,878,546 | A | | 11/1989 | Shaw et al. |
| 4,899,816 | A | | 2/1990 | Mine |
| 4,909,741 | A | | 3/1990 | Schasteen et al. |
| 4,921,386 | A | | 5/1990 | McArthur |
| 4,936,382 | A | | 6/1990 | Thomas |
| 4,962,579 | A | | 10/1990 | Moyer et al. |
| 4,962,819 | A | | 10/1990 | Bailey et al. |
| 4,971,146 | A | | 11/1990 | Terrell |
| 4,997,042 | A | * | 3/1991 | Jordan et al. ..... 166/379 |
| 5,022,472 | A | | 6/1991 | Bailey et al. |

5,036,927 A 8/1991 Willis
5,049,020 A 9/1991 McArthur
5,060,542 A 10/1991 Hauk
5,062,756 A 11/1991 McArthur et al.
5,107,940 A 4/1992 Berry
5,111,893 A 5/1992 Kvello-Aune
RE34,063 E 9/1992 Vincent et al.
5,143,154 A * 9/1992 Mody et al. ..... 277/334
5,152,554 A 10/1992 LaFleur et al.
5,191,939 A 3/1993 Stokley
5,207,128 A 5/1993 Albright
5,233,742 A 8/1993 Gray et al.
5,245,265 A 9/1993 Clay
5,251,709 A 10/1993 Richardson
5,255,751 A 10/1993 Stogner
5,272,925 A 12/1993 Henneuse et al.
5,282,653 A 2/1994 LaFleur et al.
5,284,210 A 2/1994 Helms et al.
5,294,228 A 3/1994 Willis et al.
5,297,633 A * 3/1994 Snider et al. ..... 166/387
5,297,833 A 3/1994 Willis et al.
5,305,839 A 4/1994 Kalsi et al.
5,332,043 A 7/1994 Ferguson
5,340,182 A 8/1994 Busink et al.
5,348,351 A 9/1994 LaFleur et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tassari et al.
5,441,310 A 8/1995 Barrett et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,509,442 A 4/1996 Claycomb
5,535,824 A 7/1996 Hudson
5,549,165 A * 8/1996 Brooks ..... 166/386
5,575,344 A 11/1996 Wireman
5,577,566 A 11/1996 Albright et al.
5,584,343 A 12/1996 Coone
5,588,916 A 12/1996 Moore
5,645,131 A 7/1997 Travisani
5,661,888 A 9/1997 Hanslik
5,667,026 A 9/1997 Lorenz et al.
5,682,952 A 11/1997 Stokley
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,918,673 A 7/1999 Hawkins et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 * 7/2002 Mullins ..... 166/90.1
6,431,626 B1 8/2002 Bouligny
6,443,241 B1 9/2002 Juhasz et al.
6,460,620 B1 10/2002 LaFleur
6,527,493 B1 3/2003 Kamphorst et al.
6,536,520 B1 3/2003 Snider et al.
8,527,047 3/2003 Pietras
8,553,825 4/2003 Boyd
6,571,876 B2 6/2003 Szarka
6,578,632 B2 6/2003 Mullins
6,591,471 B1 7/2003 Hollingsworth et al.
6,595,288 B2 7/2003 Mosing et al.
6,604,578 B2 8/2003 Mullins
6,622,796 B1 9/2003 Pietras
6,637,526 B2 10/2003 Juhasz et al.
8,651,737 11/2003 Bouligny
6,668,684 B2 12/2003 Allen et al.
6,668,937 B1 12/2003 Murray
6,675,889 B1 1/2004 Mullins et al.
6,679,333 B2 1/2004 York et al.
6,688,398 B2 2/2004 Pietras
6,691,801 B2 2/2004 Juhasz et al.
8,688,394 2/2004 Ayling
6,715,542 B2 4/2004 Mullins
6,722,425 B2 4/2004 Mullins
6,725,938 B1 4/2004 Pietras
6,725,949 B2 4/2004 Seneviratne
6,732,819 B2 5/2004 Wenzel
6,732,822 B2 5/2004 Slack et al.
6,742,584 B1 6/2004 Appleton
6,742,596 B2 6/2004 Haugen
6,779,599 B2 8/2004 Mullins et al.
6,832,658 B2 12/2004 Keast
8,832,656 12/2004 Cameron
6,840,322 B2 1/2005 Haynes
6,883,605 B2 4/2005 Arceneaux et al.
6,892,835 B2 5/2005 Shahin et al.
6,907,934 B2 6/2005 Kauffman et al.
6,938,697 B2 9/2005 Haugen
6,976,298 B1 12/2005 Pietras
7,004,259 B2 2/2006 Pietras
7,007,753 B2 3/2006 Robichaux et al.
7,017,671 B2 3/2006 Williford
7,028,586 B2 4/2006 Robichaux
7,073,598 B2 7/2006 Haugen
7,090,021 B2 8/2006 Pietras
7,096,948 B2 8/2006 Mosing et al.
7,096,977 B2 8/2006 Juhasz et al.

| | | | |
|---|---|---|---|
| 7,100,698 | B2 | 9/2006 | Kracik et al. |
| 7,107,875 | B2 | 9/2006 | Haugen et al. |
| 7,117,938 | B2 | 10/2006 | Hamilton et al. |
| 7,140,445 | B2 | 11/2006 | Shahin et al. |
| 7,147,254 | B2 | 12/2006 | Niven et al. |
| 7,188,686 | B2 | 3/2007 | Folk et al. |
| 7,213,656 | B2 | 5/2007 | Pietras |
| 7,325,610 | B2 | 2/2008 | Giroux et al. |
| 7,370,698 | B2 | 5/2008 | Mosing et al. |
| 2001/0042625 | A1 | 11/2001 | Appleton |
| 2002/0029878 | A1 | 3/2002 | Victor |
| 2002/0108748 | A1 | 8/2002 | Keyes |
| 2002/0170720 | A1 | 11/2002 | Haugen |
| 2003/0155159 | A1 | 8/2003 | Slack et al. |
| 2003/0164276 | A1 | 9/2003 | Snider et al. |
| 2003/0173073 | A1 | 9/2003 | Snider et al. |
| 2003/0221519 | A1 | 12/2003 | Haugen et al. |
| 2004/0003490 | A1 | 1/2004 | Shahin et al. |
| 2004/0069500 | A1 | 4/2004 | Haugen |
| 2004/0144547 | A1 | 7/2004 | Koithan et al. |
| 2004/0173358 | A1 | 9/2004 | Haugen |
| 2004/0216924 | A1 | 11/2004 | Pietras et al. |
| 2004/0251050 | A1 | 12/2004 | Shahin et al. |
| 2004/0251055 | A1 | 12/2004 | Shahin et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |
| 2006/0000600 | A1 | 1/2006 | Pietras |
| 2006/0124353 | A1 | 6/2006 | Juhasz et al. |
| 2006/0151181 | A1 | 7/2006 | Shahin |
| 2006/0180315 | A1 | 8/2006 | Shahin et al. |
| 2006/0278402 | A1 | 12/2006 | Mullins |
| 2007/0000668 | A1 | 1/2007 | Christensen |
| 2007/0181346 | A1 | 8/2007 | Swietlik et al. |
| 2008/0202751 | A1 | 8/2008 | Mosing et al. |

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 0 479 583 | 4/1992 |
| EP | 0 525 247 | 2/1993 |
| EP | 0 589 823 | 3/1994 |
| EP | 1148206 | 10/2001 |
| EP | 1 256 691 | 11/2002 |
| GB | 1 489 661 | 4/1977 |
| GB | 2 053 088 | 2/1981 |
| GB | 2 201 912 | 9/1988 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 345 074 | 6/2000 |
| GB | 2 357 530 | 6/2001 |
| JP | 2001-173349 | 6/2001 |
| WO | WO 90-06418 | 6/1990 |
| WO | WO 92-18743 | 10/1992 |
| WO | WO 93-07358 | 4/1993 |
| WO | WO 95-10686 | 4/1995 |
| WO | WO 96/07009 | 3/1996 |
| WO | WO 96-18799 | 6/1996 |
| WO | WO 97-08418 | 3/1997 |
| WO | WO 98-05844 | 2/1998 |
| WO | WO 98-11322 | 3/1998 |
| WO | WO 98-32948 | 7/1998 |
| WO | WO 99-11902 | 3/1999 |
| WO | WO 99-41485 | 8/1999 |
| WO | WO 99-58810 | 11/1999 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-39429 | 7/2000 |
| WO | WO 00-39430 | 7/2000 |
| WO | WO 00-50730 | 8/2000 |
| WO | WO 01-12946 | 2/2001 |
| WO | WO 01/33033 | 5/2001 |
| WO | WO 01-94738 | 12/2001 |
| WO | WO 2004-022903 | 3/2004 |
| WO | WO 2004/079155 | 9/2004 |
| WO | WO 2005/090740 | 9/2005 |
| WO | WO 2007/108703 | 9/2007 |
| WO | WO 2007/144597 | 12/2007 |

OTHER PUBLICATIONS

Dennis L. Bickford and Mark J. Mabile, Casing Drilling Rig Selection For Stratton Field, Texas, World Oil, vol. 226 No., Mar. 2005.

"First Success with Casing-Drilling" Word Oil, (Feb. 1999), pp. 25.

Laurent, et al., "A New Generation Drilling Rig: Hydraulically Powered and Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application;" AADE Paper 01-NC-HO-32, AADE National Drilling Conference, Mar. 27-29, 2001, pp. 1-10.

Fontenot, et al., "New Rig Design Enhances Casing Drilling Operations in Lobo Trend," paper WOCD-0306-04, World Oil Casing Drilling Technical Conference, Mar. 6-7, 2003, pp. 1-13.

Vincent, et al., "Liner and Casing Drilling—Case Histories and Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving the Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

G H. Kamphorst, G. L. Van Wechem, W. Boom, D. Bottger, and K. Koch, Casing Running Tool, SPE/IADC 52770.

* cited by examiner

ONE-POSITION FILL-UP AND CIRCULATING TOOL AND METHOD

CROSS-REFERENCE TO RELATED APPLICATIONS

This application claims benefit of co-pending U.S. Provisional Patent Application Ser. No. 60/643,339, filed on Jan. 12, 2005, which application is herein incorporated by reference in its entirety.

BACKGROUND OF THE INVENTION

1. Field of the Invention

Embodiments of the present invention generally relate to running a tubular into a wellbore. More specifically, embodiments of the present invention relate to using a circulating tool for running casing into a wellbore.

2. Description of the Related Art

To obtain hydrocarbons from an earth formation, a wellbore is typically drilled to a first depth using a drill string having a drill bit attached to its lower end. The drill string is then removed, and thereafter a first casing is lowered into the wellbore to line the wellbore. The casing may be a casing section or, in the alternative, a casing string including two or more casing sections threadedly connected to one another. After the first casing is lowered to the first depth, cement is typically circulated into an annulus between the outer diameter of the first casing and the wall of the wellbore to set the first casing within the wellbore.

After setting the first casing within the wellbore, the drill string is re-inserted into the wellbore through a bore of the first casing and used to drill to a second depth within the earth formation. The drill string is again removed, and a second casing is lowered into the wellbore and set therein using cement. This process is repeated with additional casing until casing is installed within the wellbore to the desired depth.

While the casing is being lowered into the wellbore during the "casing running" operation, the pressure within the wellbore is typically higher than the pressure within the bore of the casing. This higher pressure within the wellbore exerts stress on the casing as it is being lowered into the wellbore, risking damage or collapse of the casing during run-in; thus, a casing fill-up operation is performed, where the bore of the casing being run into the wellbore is filled with a fluid (often termed "mud") in an attempt to equalize the pressure inside the casing with the pressure outside the casing (the pressure within the wellbore) and thereby prevent collapse of the casing during the run-in operation. Pressurized fluid is typically input into the bore of the upper end of the casing using a fill line from the existing mud pumps at the well site.

At various times during running of the casing into the wellbore, the casing often sticks within the wellbore. To dislodge the casing from the wellbore, a circulating operation is performed, where pressurized drilling fluid is circulated down the casing and out into the annulus to wash sand or other debris which is causing the casing to stick out from the lower end of the casing. To force pressurized fluid out into the annulus for the circulating operation, a circulating tool is utilized.

To "rig up" the circulating tool for the circulating of fluid through the casing, the circulating tool is inserted into the bore of the casing at the upper end of the casing. A sealing member on the circulating tool is then activated to seal the circulating tool with the casing, forming a path for fluid flow through the circulating tool and out into the bore of the casing. Specifically, in a circulation operation, fluid is introduced into the circulating tool, flows through the bore of the casing and out the lower end of the casing to remove the obstructing debris, and then the fluid having the debris therein flows up the annulus to the surface of the wellbore.

After the circulation operation, the circulating tool is removed from the casing to allow another casing fill-up operation and further running of the casing into the wellbore to occur. During the casing running and fill-up operations, air must be allowed to escape through the bore of the casing to prevent over-pressurizing the bore of the casing. To permit the air being replaced by the fluid during the fill-up operation to escape from the bore of the casing, the circulating tool must be removed from the casing prior to the fill-up operation. To remove the circulating tool ("rig down"), the sealing member is de-activated, and the circulating tool is lifted from the bore of the casing. The casing may then be lowered further into the wellbore while filling the casing with fluid to prevent collapse of the casing.

Rigging up and rigging down the circulating tool, which are time-consuming procedures, must often be performed numerous times during a casing running operation. Therefore, attaching and re-attaching the circulating tool each time the casing is stuck within the wellbore during casing running is expensive and decreases the profitability of the well. Furthermore, because rig personnel perform the rigging up and rigging down of the circulating tool, which are often dangerous operations, numerous rigging up and rigging down operations decrease the safety of the well site.

Thus, there is a need for a method for circulating fluid for a circulating operation and filling up the casing with fluid for casing running and fill-up operations without the need to rig up and rig down the circulating tool every time a circulating operation must be performed. There is a further need for a circulating tool which is capable of performing both the fill-up and circulating operations without removal of the circulating tool from the casing. There is yet a further need for a circulating tool which allows air to escape while maintaining the circulating tool inside the casing during the duration of the casing running operation.

SUMMARY OF THE INVENTION

In one embodiment, a combination fill-up and circulating tool comprises a tubular body insertable within casing and capable of fluid flow through a bore thereof; and a sealing element concentrically disposed around the tubular body in an annulus between an outer diameter of the tubular body and an inner diameter of the casing, the sealing element moveable between a first position and a second position relative to the casing without moving the tubular body relative to the casing, wherein in the first position, fluid flow through the annulus past the sealing element is at least substantially prevented, and wherein in the second position, fluid flow is allowed past the sealing element within the annulus.

In another embodiment, a method of running casing into a wellbore comprises providing an apparatus comprising a fill-up and circulating tool disposed within the casing, the tool comprising a mandrel having a sealing element disposed therearound, an annulus between the mandrel and the casing capable of being at least substantially sealed from fluid flow therethrough using the sealing element; flowing a first fluid into the casing through a bore of the tool; running the casing into the wellbore while permitting fluid flow past the sealing element through the annulus; moving the sealing element relative to the mandrel to at least substantially seal the annulus from fluid flow past the sealing element; and circulating a second fluid through the casing via the bore of the tool and into an annular area between the casing and the wellbore.

In another embodiment, an apparatus for handling a tubular comprises a gripping apparatus and a fluid conduit coupled to the gripping apparatus. The fluid conduit comprises a body insertable into the tubular, the body having a bore thereof; and a sealing element disposed around the body, the sealing element moveable between a first position and a second position relative to the tubular without moving the body relative to the tubular, wherein after insertion into the tubular, the sealing element, in the first position, substantially prevents fluid flow past the sealing element is at least substantially prevented, and, in the second position, allows fluid flow past the sealing element. In another embodiment, the gripping apparatus is adapted to engage an interior surface of the tubular. In yet another embodiment, the gripping apparatus is adapted to engage an exterior surface of the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention advantageously provide a one-position fill-up and circulating tool for running casing into a wellbore. The fill-up/circulating tool of embodiments of the present invention eliminates the dangerous and costly procedure of repeatedly inserting and removing the prior art circulating tool from the casing while running the casing into the wellbore.

Figure 1:
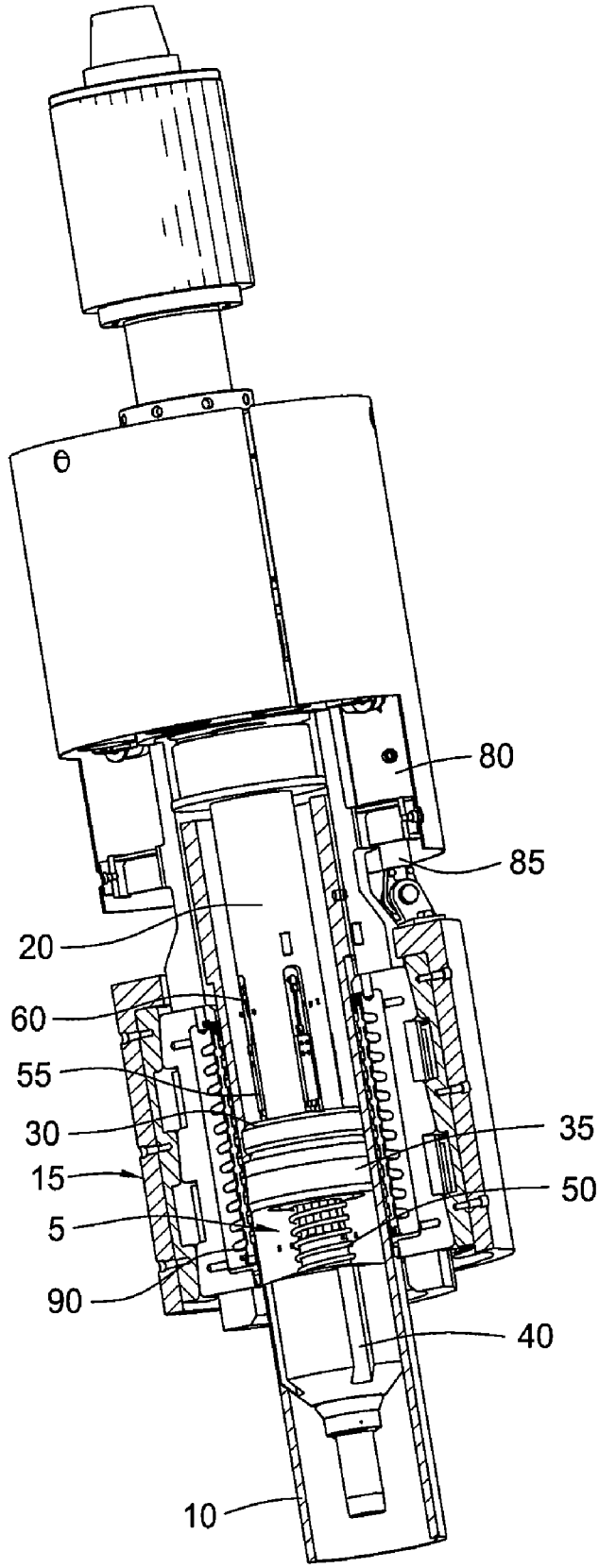
FIG. 1 is a section view of the fill-up/circulating tool inserted in the casing.

FIG. 1 illustrates a fill-up/circulating tool 5 inserted into an upper portion of casing 10. A lower portion of the fill-up/circulating tool 5 is disposed within a bore of the casing 10, while an upper end of the fill-up/circulating tool 5 is attached by a connecting member 70 (see FIGS. 2 and 3) to a gripping head such as a torque head 15 capable of grippingly engaging the outer diameter of the casing 10. The connecting member 70 may include threads on its upper end for mating with corresponding threads within the torque head 15, or the connecting member 70 may be provided in the form of any other connecting means known by those skilled in the art.

Figure 1A:
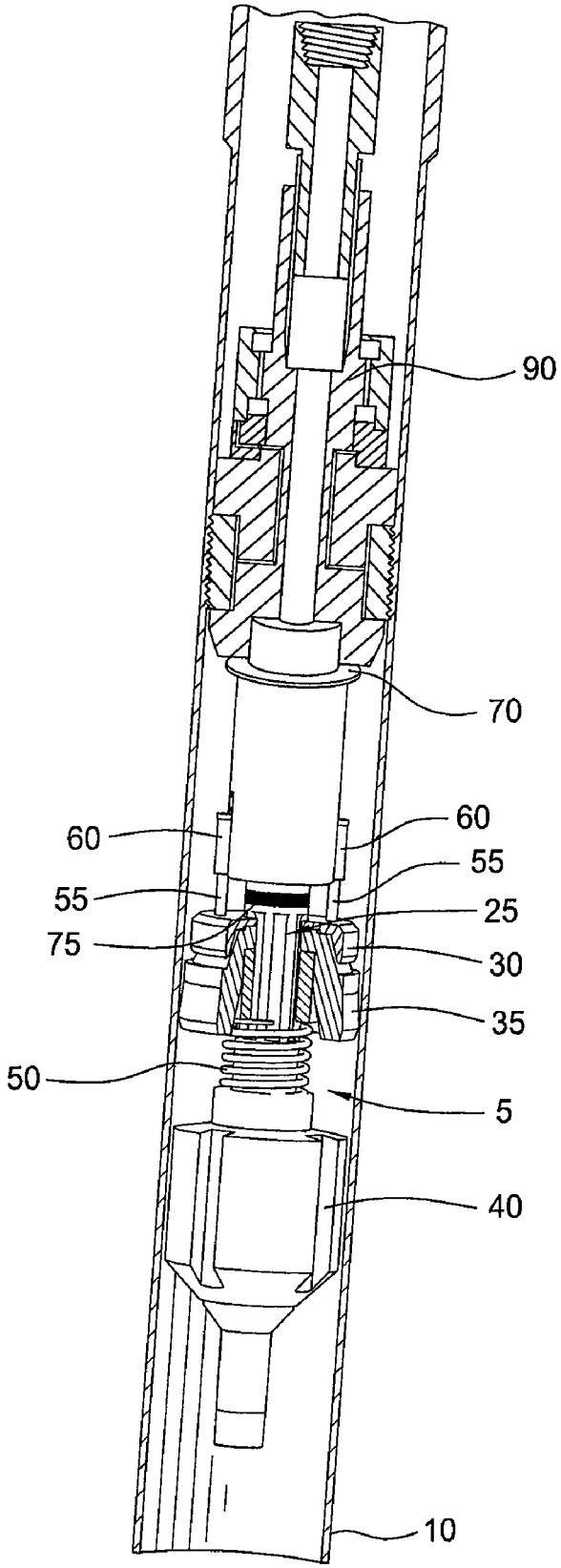

An exemplary (although not limiting) torque head usable with embodiments of the present invention is described in U.S. Pat. No. 6,311,792 B1, issued on Nov. 6, 2001 to Scott et al., which is herein incorporated by reference its entirety. Another exemplary torque head usable with embodiments of the present invention is described in U.S. Patent Application Publication No. 2005/0257933, filed by Pietras on May 20, 2004, which application is herein incorporated by reference in its entirety. In an alternate embodiment of the present invention, instead of the gripping head being a torque head, the gripping head may include a spear 90 capable of grippingly engaging the inner diameter of the casing 10, as shown in FIG. 1A. An exemplary (although not limiting) spear usable with embodiments of the present invention is disclosed in U.S. Patent Application Publication Number US 2001/0042625 A1, filed by Appleton on Jul. 30, 2001, which is herein incorporated by reference in its entirety. Regardless of its form (spear or torque head), the gripping head has a longitudinal bore therethrough through which fluid may flow and grippingly engages the casing 10 to serve as a load path to transmit torque applied from the top drive (not shown) to the casing 10.

Figure 2:
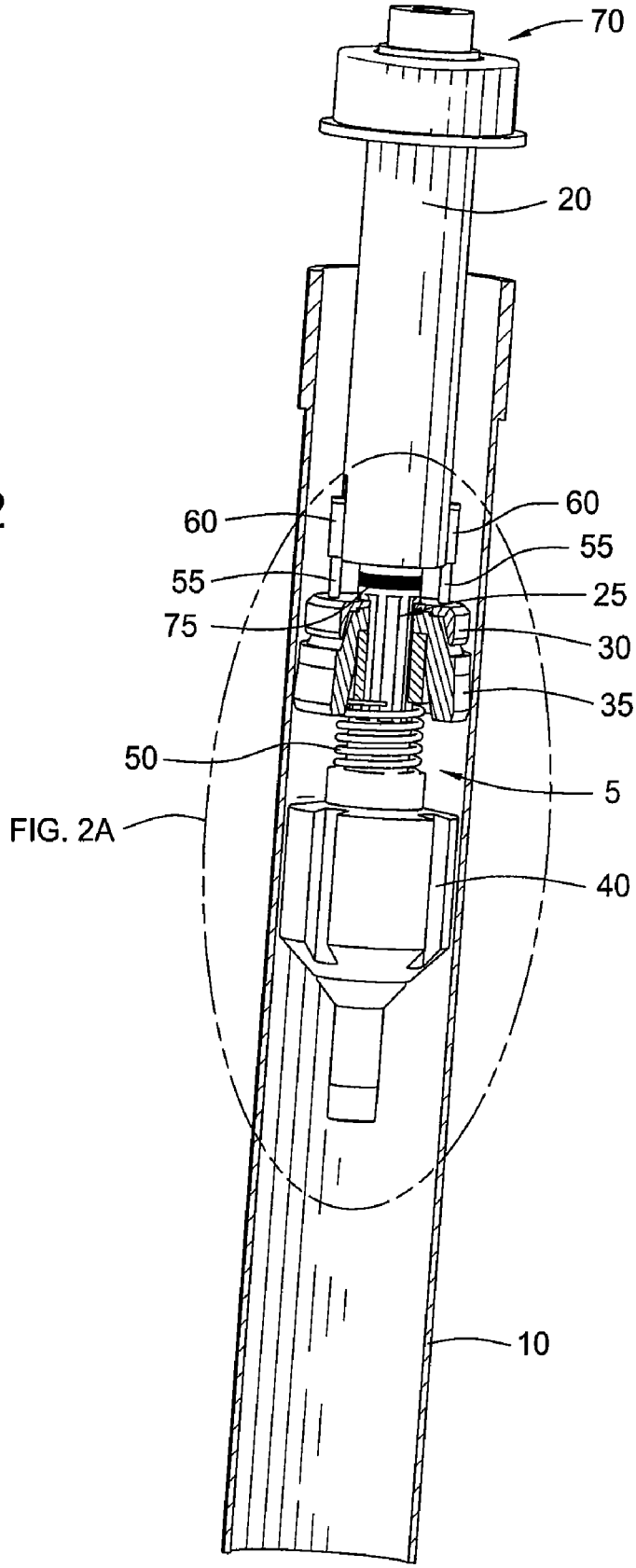
FIG. 2 is a sectional view of the fill-up/circulating tool of FIG. 1 disposed within the casing and in the fill-up position. Portions of the fill-up/circulating tool are cut away to show features of the fill-up/circulating tool.
Figure 3A:
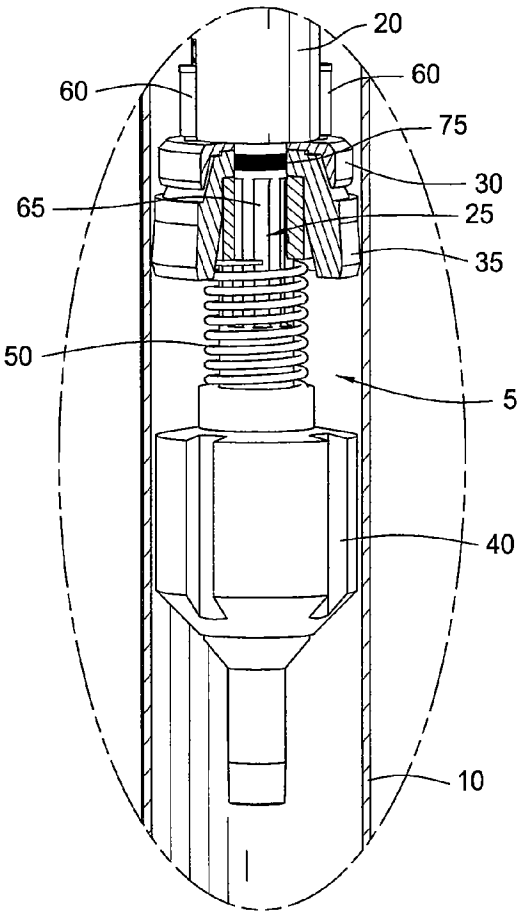
FIG. 3A is a perspective view of a portion of the fill-up/circulating tool of FIG. 1 in the circulating position. Portions of the fill-up/circulating tool are cut away to show features of the fill-up/circulating tool.
Figure 2A:
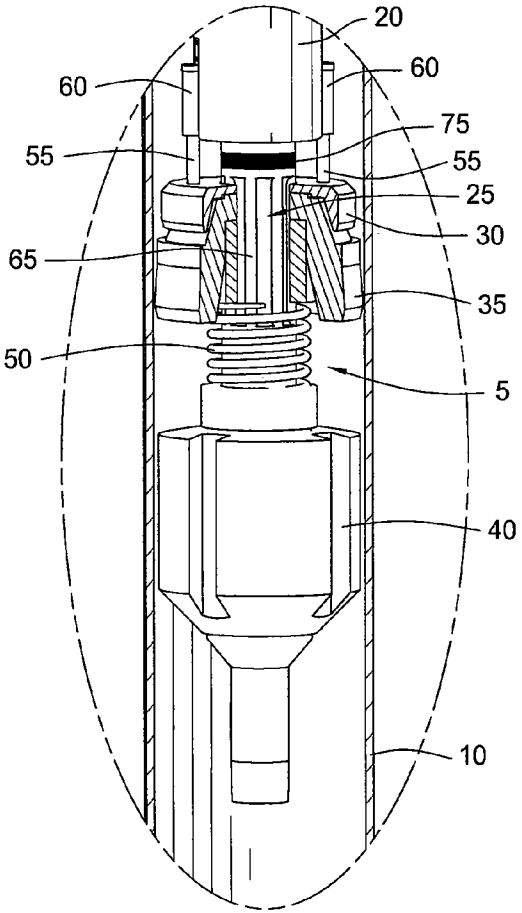
FIG. 2A is a perspective view of a portion of the fill-up/circulating tool of FIG. 1 in the fill-up position. Portions of the fill-up/circulating tool are cut away to show features of the fill-up/circulating tool.
Figure 3:
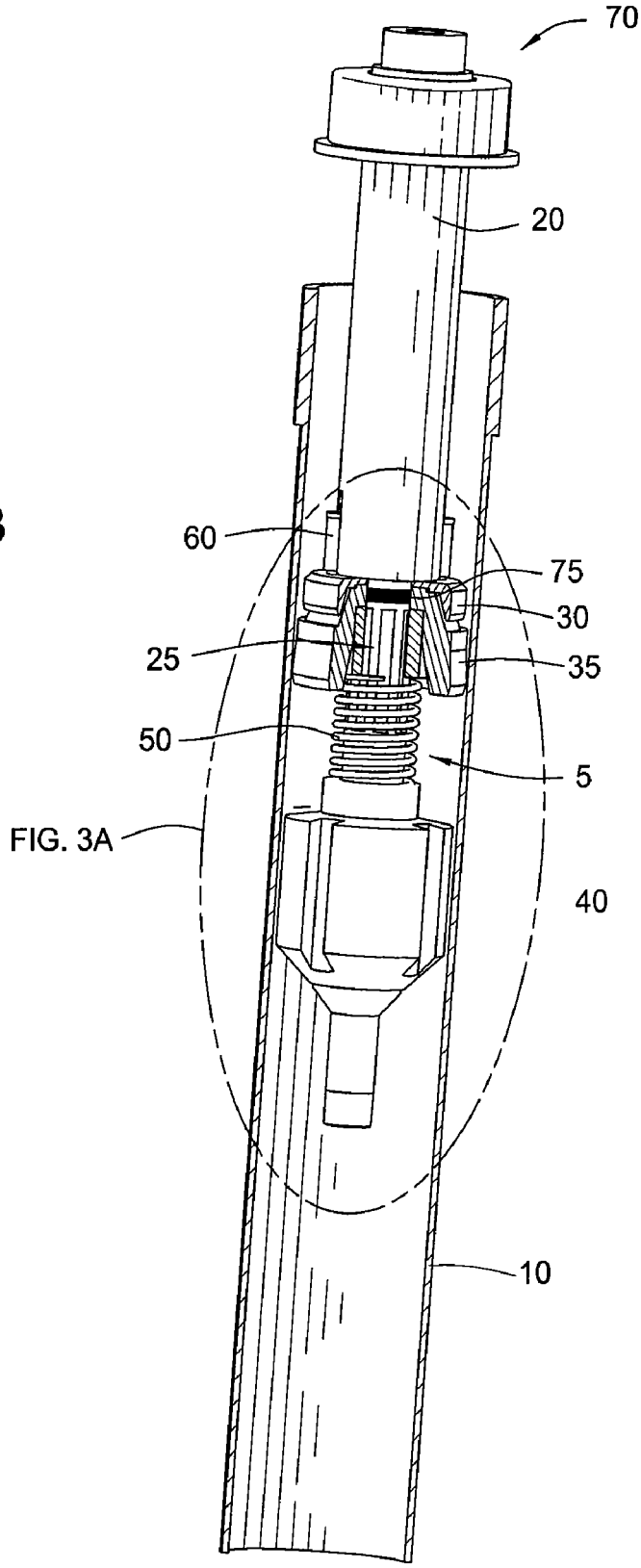
FIG. 3 is a sectional view of the fill-up/circulating tool of FIG. 1 disposed within the casing and in the circulating position. Portions of the fill-up/circulating tool are cut away to show features of the fill-up/circulating tool.

As shown in FIGS. 1-3, the fill-up/circulating tool 5 includes a mandrel 20 operatively connected to the torque head 15 at one end and operatively connected to an upper end of a mandrel 25 having one or more ridges 65 (upset portions) located in its outer diameter (see FIGS. 2 and 3). The ridges 65 are preferably longitudinally disposed along the mandrel 25. The mandrel 25 is operatively connected at its lower end to an upper end of a centralizing member 40, which may include a centralizer, stabilizer, or any other tool known to those skilled in the art which is capable of maintaining the axial position of the fill-up/circulating tool 5 relative to the casing 10. The mandrels 20 and 25 may be separate mandrels operatively connected to one another, as shown and described above, or may instead in an alternate embodiment include one continuous mandrel having a portion with longitudinally disposed grooves therein.

One or more cylinders 60 are operatively attached to the outer diameter of the mandrel 20 and are axially spaced from one another across the mandrel 20. Each cylinder 60 includes a corresponding piston 55 telescopically moveable into and out of its respective cylinder 60 in response to a force. The force may include hydraulic or pneumatic fluid behind each piston 55, or instead may include a mechanical, electrical, or optical force. A lower end of each piston 55 is capable of contacting an upper portion of a helmet 30 which concentrically surrounds the mandrel 25, as shown in FIG. 1.

The helmet 30 is operatively connected to a sealing element such as a packer cup 35 which also concentrically surrounds the mandrel 25, as illustrated in FIG. 1. Exemplary packer cups, which in one example comprise an elastomeric or similar material, are known to those skilled in the art. Preferably, the packer cup 35 extends a height which is less than the length of the ridges 65 of the mandrel 25. FIGS. 2, 2A, 3, and 3A show the fill-up/circulating tool 5 with portions of the helmet 30 and packer cup 35 cut away to illustrate the mandrel 25 disposed within the helmet 30 and packer cup 35 and the integral relations of these components of the fill-up/circulating tool 5 to one another.

Extending concentrically around the outer diameter of the mandrel 25 above the ridges 65 are one or more sealing elements 75. The sealing elements 75 are preferably o-rings. The sealing elements 75 provide a sealed environment between the mandrel 25 and the packer cup 35 when the helmet 30 is located around the sealing elements 75, as shown in FIG. 3.

A biasing member such as a spring 50 is rigidly and operatively connected at its lower end to the upper end of the centralizing member 40 and concentrically disposed around the outer diameter of the mandrel 25. The upper end of the spring 50 contacts the lower end of the packer cup 35 to provide biasing force to urge the packer cup 35 (and helmet 30) upward relative to the mandrel 25 (see FIG. 3A). The spring 50 and the piston 55 and cylinder 60 arrangement cooperate to move the packer cup 35 and helmet 30 relative to the remainder of the fill-up/circulating tool 5, thereby moving the fill-up/circulating tool 5 between the fill-up position (see FIGS. 2 and 2A) and the circulating position (see FIGS. 3 and 3A) without removing the fill-up/circulating tool 5 from the bore of the casing 10 and also without moving the position of the fill-up/circulating tool 5 (including the mandrels 20 and 25, centralizing member 40, sealing member 75, and cylinders 60) and torque head 15 relative to the casing 10. In this way, the fill-up/circulating tool 5 is a one-position fill-up and circulating tool.

The piston/cylinder arrangement and the spring 50 constitute a driving mechanism for moving the helmet 30 and the packer cup 35. Other driving means are employable in alternate embodiments of the present invention for use in moving the helmet 30 and packer cup 35 in lieu of the piston/cylinder arrangement, including but not limited to electrical, mechanical, and/or optical driving means.

The helmet 30 and packer cup 35 cooperate with the driving mechanism to act as a valve for selectively allowing or disallowing fluid (e.g., air) flow through the annulus between the fill-up/circulating tool 5 and the casing 10. Essentially, the valve is capable of selectively sealing the annulus during the circulating operation, while removing the seal from the annulus during the fill-up operation. Any other valving means known to those skilled in the art may be utilized to selectively seal the annulus in lieu of the packer cup 35, helmet 30, and associated components.

In operation, an upper end of the casing 10 is sandwiched between the torque head 15 and the fill-up/circulating tool 5 by inserting the fill-up/circulating tool 5 into the bore of the casing 10, as shown in FIG. 1. The torque head 15 is activated to grippingly engage the outer diameter of the casing 10 (or to grippingly engage the inner diameter of the casing if instead using the spear as the gripping head). Example means and methods for grippingly engaging the casing 10 are described in the above incorporated-by-reference patent and patent application involving a torque head and a spear.

The torque head 15 is lowered towards the wellbore (not shown), thereby lowering the casing 10 grippingly engaged by the torque head 15 into the wellbore. During run-in of the casing 10 into the wellbore, the fill-up/circulating tool 5 is in the fill-up position shown in FIGS. 2 and 2A. The fill-up position is achieved by activating the pistons 55 to cause them to extend from the cylinders 60 (e.g., by the introduction of the force of fluid pressure or electrical, mechanical, or optical power) so that the pistons 55 push the helmet 30 and packer cup 35 downward relative to the mandrel 25 against the bias of the spring 50. Moving the helmet 30 and packer cup 35 downward over the mandrel 25 exposes a portion of the ridges 65 above the helmet 30, thereby allowing air to escape through the ridges 65 when the casing 10 is run into the wellbore. While the air is escaping or subsequent to the air escaping through the ridges 65, fluid is introduced into the fill-up/circulating tool 5 to fill up the casing 10 with the fluid and thereby prevent collapse of the casing 10 during run-in.

When an obstruction is reached within the wellbore preventing the further lowering of the casing 10, the fill-up/circulating tool 5 may be moved to the circulating position shown in FIGS. 3 and 3A. Moving the fill-up/circulating tool 5 to the fluid-circulating position is accomplished by removing the force extending the pistons 55 from the cylinders 60. Removing this force causes the biasing force of the spring 50 to push upward against the packer cup 35, thereby moving the packer cup 35 and helmet 30 upward relative to the mandrel 25 and forcing the pistons 55 upward within the cylinders 60. The packer cup 35 and helmet 30 move upward to cover the ridges 65, consequently preventing air and other fluid flow through the ridges 65.

Pressurized fluid is then introduced into the fill-up/circulating tool 5 (via the torque head 15) to flow down through the bore of the fill-up/circulating tool 5, out through the lower end of the fill-up/circulating tool 5 and into the bore of the casing 10, out through the lower end of the casing 10, and up into the annulus between the outer diameter of the casing 10 and the wall of the wellbore. The fluid dislodges the obstructing debris or other object while circulating through the wellbore, thereby removing the sticking of the casing 10 within the wellbore.

Un-sticking the casing 10 from the wellbore and/or removal of the debris or other object obstructing the bore of the casing 10 permits lowering of the casing 10 further into the wellbore. Before or while lowering the casing 10 further into the wellbore, the fill-up/circulating tool 5 is moved to its fill-up position (see FIGS. 2 and 2A) in the same manner as described above. This circulating process (and subsequent return of the fill-up/circulating tool 5 to the fill-up position for further run-in of the casing 10 into the wellbore) is repeated as desired when the casing 10 reaches an obstruction or is stuck within the wellbore. Moreover, the circulating process may be repeated at or near the end of the lowering of the casing 10 into the wellbore to remove debris from the lower end of the casing 10 at or near its final depth location.

Although the above description relates to lowering casing 10 into a wellbore, the fill-up/circulating tool 5 may also be used to lower any other type of tubular body, including drill pipes or mandrels, into a wellbore. Furthermore, the fill-up/circulating tool 5 is not only useful in a tubular-lowering operation, but is also contemplated for use in any pipe handling operation (including make-up and break-out of tubulars) or in any drilling operation (including drilling with casing or drilling with drill pipe).

The above description utilizes terms such as "lower," "upper," and other directional terms. These directional terms are used within the description merely to provide a description of one embodiment of the present invention and are not limiting. For example, although the tubular is "lowered" into the wellbore in the description above, it is within the scope of embodiments of the present invention that the fill-up/circulating tool 5 is also usable to convey a tubular into a horizontal, lateral, and/or directional wellbore.

While the foregoing is directed to embodiments of the present invention, other and further embodiments of the invention may be devised without departing from the basic scope thereof, and the scope thereof is determined by the claims that follow.

The invention claimed is:

1. A combination fill-up and circulating tool, comprising:

a tubular body insertable within casing and capable of fluid flow through a bore thereof; and a sealing element concentrically disposed around the tubular body and sized to engage an inner diameter of the casing, wherein the sealing element is moveable between a first position and a second position, wherein in the first position, a fluid flow past the sealing element is at least substantially prevented, wherein in the second position, the fluid flow is allowed past the sealing element through at least one space between the sealing element and the tubular body, and wherein the first position is a circulating position for circulating fluid through a wellbore and the second position is a fill-up position for filling the casing with fluid for running the casing into the wellbore.

2. The tool of claim 1, further comprising a gripping member adapted to engage an interior surface of the casing.

3. The tool of claim 1, wherein the sealing element comprises a packer cup.

4. The tool of claim 1, wherein in the second position, filling the casing with fluid is via the bore.

5. A combination fill-up and circulating tool, comprising:

a tubular body insertable within casing and capable of fluid flow through a bore thereof; and a packer cup concentrically disposed around the tubular body and adapted to seal an annulus between an outer diameter of the tubular body and an inner diameter of the casing, the tubular body comprising at least one groove within a first portion of its outer surface, the packer cup moveable between a first position and a second position relative to the casing without moving the tubular body relative to the casing, wherein in the first position, fluid flow through the annulus past the packer cup is at least substantially prevented, and wherein in the second position, the packer cup is disposed over the first portion to allow fluid flow through the annulus via the at least one groove.

6. The tool of claim 5, wherein in the first position, the sealing element is disposed over a second portion of the tubular body, the second portion devoid of grooves.

7. The tool of claim 6, wherein the sealing element cooperates with a sealing element integral to the second portion when in the first position to at least substantially prevent fluid flow past the sealing element in the annulus.

8. The tool of claim 5, further comprising a driving mechanism capable of moving the sealing element between the first and second positions.

9. The tool of claim 8, wherein the driving mechanism comprises a first mechanism and a second mechanism, the first mechanism exerting a biasing force on the sealing element and the second mechanism capable of exerting an opposing force on the sealing element.

10. The tool of claim 9, wherein the first mechanism is a resilient spring.

11. The tool of claim 9, wherein the second mechanism is hydraulically actuated.

12. The tool of claim 9, wherein the second mechanism is a piston and cylinder assembly.

13. The tool of claim 9, wherein the second mechanism is electrically actuated.

14. The tool of claim 9, wherein the second mechanism is mechanically actuated.

15. The tool of claim 9, wherein the first mechanism is capable of moving the sealing element in a first longitudinal direction within the annulus and the second mechanism is capable of moving the sealing element in a second longitudinal direction within the annulus, the second direction generally opposite to the first direction.

16. The tool of claim 9, wherein the tool is in the first position when the opposing force is insufficient to overcome the biasing force.

17. A method of running casing into a wellbore, comprising:

disposing an apparatus comprising a fill-up and circulating tool within the casing, the tool comprising a mandrel having a sealing element disposed therearound, wherein the sealing element is adapted to seal an annulus between the mandrel and the casing from fluid flow therethrough;

flowing a first fluid into the casing through a bore of the tool;

running the casing into the wellbore while permitting fluid in the annulus on one side of the sealing element to flow between the sealing element and the mandrel into the annulus on the other side of the sealing element;

moving the sealing element relative to the mandrel to at least substantially seal the annulus from fluid flow therethrough; and circulating a second fluid through the casing via the bore of the tool and into an annular area between the casing and the wellbore.

18. The method of claim 17, wherein moving the sealing element relative to the mandrel is accomplished without moving the mandrel relative to the casing.

19. The method of claim 17, wherein moving the sealing element relative to the mandrel comprises moving the sealing element in a first direction; and further comprising moving the sealing element in a second direction relative to the mandrel, thereby permitting fluid flow between the sealing element and the mandrel.

20. The method of claim 19, further comprising running the apparatus further into the wellbore.

21. The method of claim 17, wherein the sealing element is in a first position relative to the mandrel when fluid flow is permitted between the sealing element and the mandrel, and wherein the sealing element is in a second position relative to the mandrel when the annulus is at least substantially sealed from fluid flow past the sealing element.

22. The method of claim 21, wherein the sealing element is biased towards the second position by a biasing force.

23. The method of claim 22, wherein the biasing force is a resilient spring.

24. The method of claim 22, wherein moving the sealing element from the second position to the first position is accomplished when an opposing force overcomes the biasing force.

25. The method of claim 24, wherein the opposing force is a piston and cylinder assembly.

26. The method of claim 17, wherein the casing is at least substantially sealed from fluid flow therethrough using the sealing element in cooperation with a sealing element integral to the mandrel.

27. The method of claim 17, further comprising coupling the apparatus to a gripping apparatus.

28. The method of claim 27, wherein the gripping apparatus engages an interior surface of the casing.

29. The method of claim 27, wherein the gripping apparatus engages an exterior surface of the casing.

30. The method of claim 17 wherein the fill-up and circulating tool is disposed in the upper end of the casing, the upper end of the casing being outside of the well bore.

31. The method of claim 30 wherein the sealing element comprises a packer cup.

32. An apparatus for handling a tubular, comprising:

a gripping apparatus;

a fluid conduit coupled to the gripping apparatus, said fluid conduit comprising:

a body insertable into the tubular, the body having a bore therethrough; and a sealing element disposed around the body, the sealing element moveable between a first position and a second position relative to the tubular without moving the body relative to the tubular, wherein after insertion into the tubular, the sealing element, in the first position, substantially prevents fluid flow past the sealing element, and, in the second position, allows fluid from one side of the sealing element to flow between the sealing element and the body to the other side of the sealing element.

33. The apparatus of claim 32, wherein the gripping apparatus is adapted to engage an interior surface of the tubular.

34. The apparatus of claim 32, wherein the gripping apparatus is adapted to engage an exterior surface of the tubular.

35. The apparatus of claim 34 wherein the sealing element comprises a packer cup.

36. A combination fill-up and circulating tool for use with a casing, comprising:

a tubular body insertable within the casing and having a bore capable of fluid flow therethrough, the outer surface of the tubular body and the inner surface of the casing defining an annulus;

a sealing element concentrically disposed around the tubular body in the annulus, the sealing element being capable of substantially sealing the annulus so that fluid cannot flow between the sealing element and the casing; and a bypass fluid path being selectively operable by the sealing element between an open position and a closed position, wherein in the open position, fluid in the annulus on one side of the sealing element is allowed to flow through the bypass fluid path into the annulus on the other side of the sealing element while the sealing element is engaged with an inner diameter of the casing, and wherein in the closed position, the bypass fluid path is substantially sealed so that fluid in the annulus on one side of the sealing element cannot flow through the bypass fluid path into the annulus on the other side of the sealing element.

37. The tool of claim 36, wherein the bypass fluid path comprises at least one groove within an outer surface of the tubular body.

38. The tool of claim 36, further comprising a driving mechanism capable of moving the sealing element between the open position and the closed position.

39. The tool of claim 36 wherein the sealing element comprises a packer cup.

40. The tool of claim 36 wherein, in the closed position, the bypass fluid path is sealed by the sealing element.

41. A method of running casing into a wellbore, comprising:

disposing a fill-up and circulating tool within the casing, the tool having:

a mandrel and a sealing element disposed around the mandrel, wherein an annulus is defined between the outer surface of the mandrel and the inner surface of the casing, and wherein the sealing element at least substantially seals the annulus when the tool is disposed within the casing; and a bypass fluid path;

flowing a fluid into the casing through a bore of the tool;

running the casing into the wellbore while permitting air in the annulus on one side of the sealing element to flow through the bypass fluid path into the annulus on the other side of the sealing element;

moving the sealing element relative to the mandrel to at least substantially seal the bypass fluid path so that air in the annulus on one side of the sealing element cannot flow into the annulus on the other side of the sealing element; and circulating the fluid through the casing via the bore of the tool and into an annular area between the casing and the wellbore.

42. The method of claim 41, wherein permitting air in the annulus on one side of the sealing element to flow through the bypass fluid path into the annulus on the other side of the sealing element comprises permitting air in the annulus below the sealing element to flow through the bypass fluid path into the annulus above the sealing element.

43. The method of claim 41, wherein disposing the fill-up and circulating tool within the casing further comprises disposing the fill-up and circulating tool in the upper end of the casing, the upper end of the casing being above the well bore.

44. A method of running casing into a wellbore, comprising:

disposing a fill-up and circulating tool within the casing, the tool having:

a mandrel and a sealing element disposed around the mandrel, wherein an annulus is defined between the outer surface of the mandrel and the inner surface of the casing; and a bypass fluid path;

running the casing into the wellbore while permitting air in the annulus on one side of the sealing element to flow through the bypass fluid path into the annulus on the other side of the sealing element;

closing the bypass fluid path and substantially preventing air from flowing through the bypass fluid path;

sealing the annulus with the sealing element and substantially preventing air from flowing through the annulus; and circulating a fluid through the casing via the bore of the tool and into an annular area between the casing and the wellbore.

45. The method of claim 44, wherein permitting air in the annulus on one side of the sealing element to flow through the bypass fluid path into the annulus on the other side of the sealing element comprises permitting air in the annulus below the sealing element to flow past the sealing element into the annulus above the sealing element.

46. A method of running casing into a wellbore, comprising:

disposing a fill-up and circulating tool within the casing, the tool having:

a mandrel and a sealing element disposed around the mandrel, wherein an annulus is defined between the outer surface of the mandrel and the outer surface of the casing; and a bypass fluid path;

running the casing into the wellbore while flowing a fluid into the casing through a bore of the tool and while permitting air in the annulus on one side of the sealing element to flow through the bypass fluid path into the annulus on the other side of the sealing element;

closing the bypass fluid path and substantially preventing air from flowing through the bypass fluid path;

sealing the annulus with the sealing element and substantially preventing air from flowing through the annulus; and circulating the fluid through the casing via the bore of the tool and into an annular area between the casing and the wellbore.

47. The method of claim 46, wherein permitting air in the annulus on one side of the sealing element to flow through the bypass fluid path into the annulus on the other side of the sealing element comprises permitting air in the annulus below the sealing element to flow past the sealing element into the annulus above the sealing element.

* * * * *

UNITED STATES PATENT AND TRADEMARK OFFICE

CERTIFICATE OF CORRECTION

PATENT NO. : 7,694,744 B2
APPLICATION NO. : 11/331397
DATED : April 13, 2010
INVENTOR(S) : Shahin It is certified that error appears in the above-identified patent and that said Letters Patent is hereby corrected as shown below:

Title page, In the References Cited item (56):

Please delete "1,728,138 A 9/1929 Power" and insert --1,728,136 A 9/1929 Power-- therefor;

Please delete "3,087,548 A 4/1963 Wooley" and insert --3,087,546 A 4/1963 Wooley-- therefor;

Please delete "3,193,118 A 7/1965 Kenneday et al." and insert --3,193,116 A 7/1965 Kenneday et al.-- therefor;

Please delete "8,527,047 3/2003 Pietras" and insert --6,527,047 B1 3/2003 Pietras-- therefor;

Please delete "8,553,825 4/2003 Boyd" and insert --6,553,825 B1 4/2003 Boyd-- therefor;

Please delete "8,651,737 11/2003 Bouligny" and insert --6,651,737 B2 11/2003 Bouligny-- therefor;

Please delete "8,688,394 2/2004 Ayling" and insert --6,688,394 B1 2/2004 Ayling-- therefor;

Please delete "8,832,656 12/2004 Cameron" and insert --6,832,656 B2 12/2004 Fournier, Jr. et al.-- therefor;

Please delete "GB 1 489 661 4/1977" and insert --GB 1 469 661 4/1977-- therefor;

Column 9, Claim 35, Line 21, please delete "34" and insert --32-- therefor.

Signed and Sealed this

Twenty-seventh Day of July, 2010

David J. Kappos

David J. Kappos
*Director of the United States Patent and Trademark Office*